US005329874A

United States Patent [19]

Posey

[11] Patent Number: 5,329,874

[45] Date of Patent: Jul. 19, 1994

[54] PORTABLE TENNIS SCORE KEEPER

[76] Inventor: William L. Posey, 19803 Almaden Rd., San Jose, Calif. 95120

[21] Appl. No.: 975,840

[22] Filed: Nov. 13, 1992

[51] Int. Cl.[5] ..... A63B 71/06; G09F 9/00

[52] U.S. Cl. ..... 116/222; 40/617; 116/307; 273/DIG. 26

[58] Field of Search ..... 116/222, 225, 223, 306, 116/307; 273/DIG. 26, 73, 29 R; 40/617, 492

[56] References Cited

U.S. PATENT DOCUMENTS

| | | | |
|---|---|---|---|
| 985,655 | 1/1910 | Brown . | |
| 1,279,539 | 9/1918 | Haggerty | 116/222 X |
| 1,714,929 | 2/1928 | Smith . | |
| 1,985,652 | 3/1933 | Campbell . | |
| 2,702,954 | 3/1951 | Cline et al. . | |
| 2,704,048 | 5/1952 | Perier . | |
| 3,030,718 | 4/1962 | Kirkman | 40/617 |
| 3,246,411 | 4/1966 | Aafedt | 116/222 |
| 3,564,759 | 2/1971 | Buttermore | 40/617 X |
| 3,730,131 | 8/1972 | Izzo . | |
| 3,986,715 | 9/1975 | Glick . | |
| 4,158,342 | 8/1978 | Scruggs . | |
| 4,498,669 | 3/1984 | Bowen . | |
| 4,756,109 | 7/1988 | Marcus | 40/617 X |

FOREIGN PATENT DOCUMENTS

| | | | |
|---|---|---|---|
| 4357895 | 6/1980 | Australia . | |
| 4132187 | 9/1977 | Fed. Rep. of Germany . | |
| 4557215 | 10/1983 | Sweden . | |
| 2215617 | 9/1989 | United Kingdom | 116/222 |

*Primary Examiner*—Daniel M. Yasich
*Attorney, Agent, or Firm*—John J. Leavitt

[57] ABSTRACT

A portable tennis score keeper designed to keep the set score in the game of tennis. The set score is most often the most disputed score in the game. This invention allows any one of the players to simply flip over numbered plates to reflect the progress of each team's set score. The score keeper is simple in design, and is small enough to allow every tennis player to have it as a standard item in their sports bag. The two sets of plates suspended from notches on both sides of an elongated support member have inverse color combinations to identify each of the teams. The numbers zero through six reflects the number of games each team can win in each set. The number six is the last plate and is the total number of games required to win a set. The first numbered plate bears the word "love" inside the zero, an indicia in historical tennis score keeping terms for zero. The elongated support member of the plates is attached to a tenon having a hook and eye inserted at the top which enables the score keeper to be hooked at the net or on the fence surrounding a tennis court.

5 Claims, 1 Drawing Sheet

16
18

10
12
14
12

24
26

20
22
16
10
12
12

32
30
28

PORTABLE TENNIS SCORE KEEPER

BACKGROUND OF THE INVENTION

1. Field of the Invention.

This invention relates to the game of tennis and specifically to an improved, novel and portable method of keeping the set score.

2. Description of the Prior Art.

The game of tennis is played between two players for singles and four players for doubles. To win a singles or doubles match the player(s) must win six games to win a set; and to win a match they must win either two out of three sets or three out of five sets depending upon the pre-determined length of competition.

The set score is the longest most important score to reflect who is winning the match. Tennis is a particularly fast-moving game and it is easy to forget the set score at a given instant. The great increase in popularity of this game in recent years has increased the importance of this problem. Any device to be effective for this purpose must be visible to all players to prevent the point of questioning between opponents of the set score.

The portable tennis score keeper provides a clear and novel way to display the set score. It is viewable to players and spectators. Any one of the players may participate in rotating the plates to reflect each individual's or team's set score. This eliminates the necessity of a third party and the set score can be confirmed by all players at a glance.

Prior to this invention, a number of dial-type tennis score keepers have been proposed. For the most part these dial type tennis score keeping devices are adapted to be worn on the player's wrist. These dial-type score keepers are alike in the number of significant disadvantages and drawbacks they share.

First, it is extremely difficult to hold the racquet in one hand, the ball in the other hand and rotate the dials. Secondly, the size of the numbers on the dials are so small, they are very difficult to read especially for players who use reading glasses. Third, these types of score keeping devices are not viewable by the other player(s) or spectators leading to the questioning of the accuracy of the set score.

Another category of tennis score keepers proposed prior to this invention are those which attach to the butt, throat, side or frame of the racquet. Tennis, today, is a game with high tech equipment; racquets are built with balance and lightness as desirable components. Those inventions made to attach to the racquet detract from the racquet's attributes. Further, the tennis score keepers in this category have not developed a successful way of assuring that the device will stay attached to the racquet under playing conditions as well as not interfere with the racquet's performance. Again, these types of score keeping device display the tennis score only to the player who has it attached to his or her racquet.

An obvious flaw in the two types of score keepers described is the fact that once a part of the device is broken the entire device is rendered obsolete. This applies to the molded plastic devices as well as the devices with dials, and various sizes of small and intricate moveable parts.

Accordingly, it is one of the most important objects of the present invention to provide a portable tennis score keeper that is light, practically indestructible, viewable by players and spectators, and readily manipulated to display the set score in a tennis match.

Another object of this invention is to provide a portable, and novel way to display the set score while involving all players in rotating the score plates to accurately display the set score. It is a still further object of the invention to provide a tennis score keeping device of small size and portability so that it enables all players the opportunity to have a portable tennis score keeper as a standard item in their sports bag.

Yet another object of the invention is to provide a portable tennis score keeper that is simple to operate and viewable by all participating players as well as spectators.

A still further object of the invention is to provide a scoring device for the game of tennis which is simple in structure, reliable, functional, and economical to manufacture.

The invention possesses other objects and features of advantage, some of which with the foregoing, will be apparent from the following description and the drawings. It is to be understood, however, that the invention is not limited to the embodiment illustrated and described since it may be embodied in various forms within the score of the appended claims.

SUMMARY OF THE INVENTION

In terms of broad inclusion, the tennis score keeping device comprises an elongated support member on opposite ends of which are suspended correspondingly numbered score plates. The plates at one end are of a different color from the plates at the opposite end, and one or more of the plates may have printed thereon indicia other than numbers. Means are provided medianly on the elongated support member for suspending the device where it is visible to players and spectators where any of the players or an assistant may manipulate the plates to display the score at any given time during the tennis match.

DESCRIPTION OF PREFERRED EMBODIMENT

Figures 1, 2, 3, 4, 5, 6:
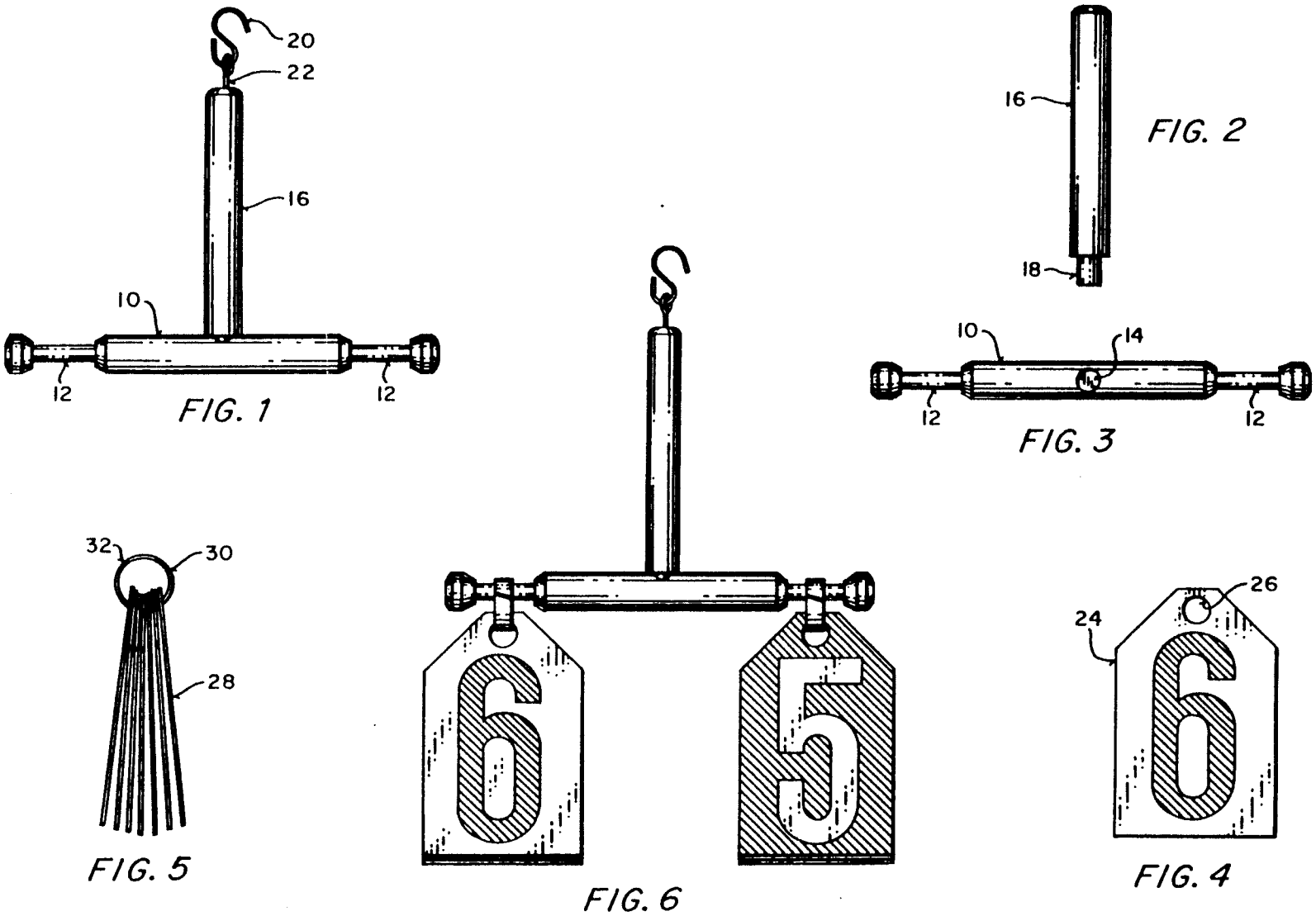
FIG. 1 is a front elevational view of a partially assembled tennis score keeping device according to my invention.
FIG. 2 is a fragmentary elevational view of a portion of the device.
FIG. 3 is a top plan view of the elongated support forming a part of the device and from which the score plates are suspended.
FIG. 4 is a front elevational view of one of the seven plates numbered zero through six. Each plate flipped over represents a different game of the set.
FIG. 5 is a side view of a polyvinyl chloride ring from which seven numbered plates are suspended.
FIG. 6 is a front elevational view of the completed device.

In terms of greater detail, as shown in FIGS. 1, 2, and 3, the portable tennis score keeper's frame includes two wooden rods. Numeral 10 depicts the seven inch wooden rod which is the horizontal base of the portable tennis score keeper. Numeral 12 is the one inch notch on both ends of the seven inch rod and the holder of the polyvinyl chloride ring (30). Numeral 14 is the centered three eighths inch bore which has a depth of three eighths inches. Numeral 16 is the four inch wooden rod designed to fit into the centered bore 14 of the seven inch rod in a perpendicular manner as illustrated. Numeral 18 is the exposed tenon at the end of the four inch wooden rod. This tenon fits into the centered hole, Numeral 14, of the seven inch wooden rod (10).

Numeral 20 is the "S" hook designed to be hooked on the fence around a tennis court. Numeral 20 is attached to Numeral 22, a threaded eye. The threaded eye, Numeral 22 is screwed into Numeral 16, the four inch wooden rod.

Numeral 24 is one of the seven indicia plates which measure two and one half inches wide, four inches long, and 0.040 inches in thickness and preferably fabricated from plastic. Numeral 26 is the half inch hole designed to hold the numbered plates on the reduced diameter notched portion 12 of rod 10. Numeral 28 is all of the seven plates numbered zero to six in one aspect, or from 1–6 plus a plate bearing the word "love" thereon for a set of seven plates. Numeral 30 depicts the PVC ring from which the numbered plates are suspended. Numeral 32 is the opening which allows the numbered plates to be inserted or removed.

The described portable tennis score keeper is compactly designed by the use of six main parts. The major structure of the portable tennis score keeper utilizes wooden rods. These rods are durable and are the holder of the plastic numbered plates which are suspended from each notched end to reflect the set score. The use of polyvinyl chloride rings to suspend the cards enables the cards to be rotated easily. Use of different contrasting colors on the numbers and their background lends to the viewability of the score keeper for the players on the tennis court and from spectator areas.

From the foregoing it is seen that a score keeper has been fully described which provides for the recording of the set score in the game of tennis. Further the invention meets the stated objects of the invention.

Although this invention has been described in detail by way of drawings and description, it is understood that certain changes and modifications may be made within the spirit of the invention and scope of the following claims:

I claim:

1. A portable scoring device for the game of tennis, comprising:

a) a geometrically configured base structure including an elongated support member;

b) a multiplicity of indicia-bearing plates constituting a set suspended from each end of the elongated support member, the indicia-bearing plates of each set being manipulable to display indicia indicative of the tennis points and set scores at any given time during the game; and c) means medianly attached on said elongated support member to suspend said device for facility in manipulating the indicia-bearing plates and viewing the score displayed thereby.

2. The portable scoring device as defined in claim 1, wherein said elongated support member comprises a cylindrical rod.

3. The portable scoring device as defined in claim 1, wherein said multiplicity of indicia-bearing cards are fabricated from plastic.

4. The portable scoring device as defined in claim 1, wherein said elongated support member is provided with a notch adjacent opposite ends, said indicia-bearing plates are each provided with an aperture adjacent corresponding ends, and a ring engaging the apertures in each set of indicia-bearing plates and engaging the notch adjacent each end of the elongated support member, whereby said sets of indica-bearing plates are suspended from opposite ends of said elongated support member in a manner to render viewable by an observer the indicia on the foremost bearing plate of each set.

5. The portable scoring device as defined in claim 4, wherein said means is medianly positioned on said elongated support member comprises an elongated bar having one end thereof engaging the elongated support member, and means on the end of the elongated bar remote from the support member for suspending to device from a supporting structure.

* * * * *